US005693919A

United States Patent [19]

Sager et al.

[11] Patent Number: 5,693,919

[45] Date of Patent: Dec. 2, 1997

[54] EVACUATION SYSTEM FOR ELEVATORS

[75] Inventors: Edmund Sager, Meggen; Patrick Chénais, Ebikon, both of Switzerland

[73] Assignee: Inventio AG, Hergiswil, Switzerland

[21] Appl. No.: 556,521

[22] Filed: Nov. 13, 1995

[30] Foreign Application Priority Data

Nov. 15, 1994 [CH] Switzerland ..... 3414/94

[51] Int. Cl.[6] ..... B66B 1/36; B66B 1/34

[52] U.S. Cl. ..... 187/282; 187/283; 187/290; 187/391

[58] Field of Search ..... 187/282, 283, 187/288, 290, 391, 393, 394

[56] References Cited

U.S. PATENT DOCUMENTS

| | | | |
|---|---|---|---|
| 4,015,689 | 4/1977 | Johnson | 187/62 |
| 4,127,843 | 11/1978 | Anzani et al. | 340/21 |
| 4,220,222 | 9/1980 | Kamaike et al. | 187/29 R |
| 4,354,171 | 10/1982 | Youshida | 340/21 |
| 4,363,453 | 12/1982 | Sérina | 187/29 R |
| 4,898,263 | 2/1990 | Manske et al. | 187/133 |
| 5,373,122 | 12/1994 | Henry | 187/394 |
| 5,411,117 | 5/1995 | Häyrinen | 187/360 |

FOREIGN PATENT DOCUMENTS

| | | |
|---|---|---|
| 0065501 | 12/1982 | European Pat. Off. . |
| 0578238 | 1/1994 | European Pat. Off. . |
| 2437731 | 4/1990 | France . |
| 6016359 | 1/1994 | Japan . |
| 207119 | 9/1989 | Switzerland . |
| 2017346 | 10/1979 | United Kingdom . |
| 8705282 | 9/1987 | WIPO . |

OTHER PUBLICATIONS

M. Spitzer, Lift Report, Jan./Feb. 1994, pp. 19–22.

*Primary Examiner*—Robert Nappi

*Attorney, Agent, or Firm*—Howard & Howard

[57] ABSTRACT

An apparatus for performing an evacuation journey of an elevator car includes at least one brake control apparatus mounted on the car and an evacuation drive. In the case of an interruption in the normal travel of the car, an evacuation journey is initiated by an evacuation control in the evacuation drive. The elevator brake is released and the evacuation control moves the car to the next floor at a reduced speed. On reaching the next floor, a brake pawl of the brake control apparatus pivots into a switching opening or runs up onto a switching cam and thus initiates the final braking of the car by actuation of a brake control contact. Upon arrival in the door zone, the car and floor doors are pushed partially open by a spring so that confined passengers can further open the doors and release themselves.

15 Claims, 7 Drawing Sheets

12
23
24
22
Entraining member
Door drive
Door motor brake
25
Display
21
TO FIG. 3
21a
Evacuation control
21b
20
11a
Elevator control
TO FIG. 3
Battery
Relay
Braking generator
11
13
19
18
Gear
Brake
Motor
Clutch
Transmission
14
15
9
16
10
17
4

1
6
2
30
11a
FROM FIG. 2
30
34
35
31
40
41
39
21a
33
42
FROM FIG. 2
32
38
37
36
26
28a
29
8
44
27
28
45
21b
43
FROM FIG. 2
46

Functional course of an evacuation journey

Functional course of a resetting journey

EVACUATION SYSTEM FOR ELEVATORS

BACKGROUND OF THE INVENTION

The present invention relates generally to an apparatus for evacuating an elevator car and, in particular, to an apparatus for automatically moving a stopped car to the next floor and partially opening the car and floor doors.

Different evacuation systems are known such as, for example, a direct or indirect emergency drive which is fed from a battery by way of current inverters for operating the elevator motor and the door motor, an evacuation control with emergency safety circuits and an additional shaft position information circuit also fed from the battery. The potential energy of the unbalanced mass of the car is exploited as far as possible in the case of cable elevators with a counterweight and usually takes place so that the load moment and its direction is detected at the drive pulley before the evacuation journey and the rotational direction for the emergency drive is chosen in accordance with the prevailing load moment direction. The driving power source for an evacuation journey need then be designed only for the unbalanced state; thus, for example, for car with a half load, for overcoming the frictional forces.

The present state of the art of such systems is explained in a technical article published in the LIFT REPORT, Volume 1 (January/February 1994), on pages 19 to 22.

An evacuation system of this kind is illustrated and described in the British patent specification 2 017 346. The elevator motor is fed from the battery by way of a first converter and the brake is fed from the battery by way of a second converter. Furthermore, as described in the above identified technical article, the rotational direction most favorable for the turning moment is likewise chosen. In summary, this solution represents an emergency feed of the existing control and drive components.

By reason of the energy conversion (current and frequency converters) to be carried out for the hoist and door motor, as well as the additionally required shaft information equipment, the technical effort and the expenditure in terms of cost become very high and, due to the complexity inevitably connected therewith, the operational reliability is also reduced.

A simple self-release system, which is illustrated for a typical cable elevator, is illustrated in the Swiss patent specification 207 119. Upon actuation of an alarm, the stopped elevator car is uncoupled from the carrier yoke and let down to a "safety exit" by means of a cable winch with centrifugal brake mounted in the carrier yoke. There, a manually actuated rotary door can then be pushed open and the car can be exited. The potential energy of the car mass is utilized as the driving force exclusively for the evacuation journey.

This self-release system has no control and no shaft position information. Furthermore, this elevator does not have any automatic floor and car door operation. Its application to present day elevator systems is not possible, in particular, for the reason that the relevant regulations demand at least one car door closed automatically during the elevator travel. Furthermore, the illustration and description in the patent specification do not show how the stopping of the car is to take place at the "safety exit".

The stopping of an elevator car after an evacuation journey represents a special problem on its own, in particular, when one does not want to or can not utilize the available shaft position information. For this purpose, separate solutions have become known, by which a stopping at a floor takes place by mechanical means in a constrained manner.

The U.S. Pat. No. 4,015,689 shows safety blocking equipment active in the elevator shaft. A dangerous excess speed is detected by means of light barriers and, when this is the case, arresting bolts are pushed into the shaft from walls on opposite sides of the car, on which bolts the car impacts and is stopped. For the purpose of damping the impact, the blocking bolts are supported in a damped manner and can thus cause a small braking travel which reduces the retardation values somewhat. This equipment is not intended and also not suitable for the final stopping at the end of an evacuation journey. Moreover, an enormous technical effort is also required to implement such equipment.

The European patent specification 0 578 238 describes and shows pawls, which are extendible from the car, that rest on projections in the shaft and prevent the gradual lowering of an hydraulic elevator car which is stopped at an upper floor for a long time. An application of this principle for the termination of an evacuation journey would require an impermissibly low travel speed, since otherwise the impact would be too brutal or the damping equipment would be too expensive. Too low an evacuation journey speed can moreover prolong the evacuation journey beyond a tolerable degree, which cannot reasonably be expected of the confined passengers in every case.

A combination of "mechanical" shaft information and evacuation equipment is disclosed by the European patent specification O 065 501. This equipment is an hydraulic/mechanical system which needs no electrical energy. An hydraulic pressure storage device is provided as an energy storage device which feeds an hydraulic motor, but also supplies a clutch with energy and executes an hydraulic brake lifting. Serving as a shaft position information source in one case is a tilted-out roller which in the floor region runs up onto a ramp mounted on the shaft wall and then, by way of a mechanical connection with the machine room, actuates the control valves which cause the stopping. Such an hydraulic system is extensive and very expensive in the case of the quality required for safety equipment. Furthermore, an device for the loading of the hydraulic storage device and its pressure monitoring is absent. Likewise, a solution for the door opening is absent from this patent specification.

SUMMARY OF THE INVENTION

The present invention concerns an apparatus for operating an elevator system to perform an evacuation journey. The elevator system includes an elevator car which travels along guides mounted in an elevator shaft. The car has an automatic door system with car doors, a motor is coupled to the car for moving the car in upward and downward directions between floors along the guides and a brake is coupled to the car for stopping the car at the floors. An elevator control is connected to the door system for automatically opening and closing the car doors at the floors, to the motor for moving the car between the floors and to the brake for stopping the car at the floors. An evacuation control is connected to the elevator control and to the automatic door system for sensing a disturbance in a normal operation of the car and automatically moving the car in the elevator shaft on an evacuation journey to a nearby floor for release of passengers confined in the car. A means for regulating a speed of the car during the evacuation journey is connected to the evacuation control and mechanically coupled to the motor and the brake. At least one brake control apparatus is mounted on the car and is connected to the evacuation control for initiating a final stop at the nearby floor. Shaft position information means is mounted in the elevator shaft adjacent the floors for actuating the brake control apparatus to stop the car. A spring means is attached to the door system for pushing door panels of the door system partially open at an end of said evacuation journey to permit passengers to exit at the floor.

The present invention has the object of creating an evacuation system for elevators, which eliminates the indicated defects of the known systems and makes an automatic and reliable release of confined passengers possible at a favorable cost and by simple means.

A first advantage is that no person need act from outside the car for an evacuation and, therefore, no special communication means, such as a telephone or remote monitoring, need be provided.

Persons confined by a sudden interruption of operation do not feel helpless or threatened, since the car is driven to a floor in a relatively short time and the door then opens at least partially. Thereby, visual contact with the outside world is possible and the door can be pushed open manually with a minimal effort by gripping the exposed door edge, whereby the confined passengers can release themselves.

Further advantages are that the evacuation system can be structured flexibly and, for example, be adapted to different elevator and door systems and special system requirements.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
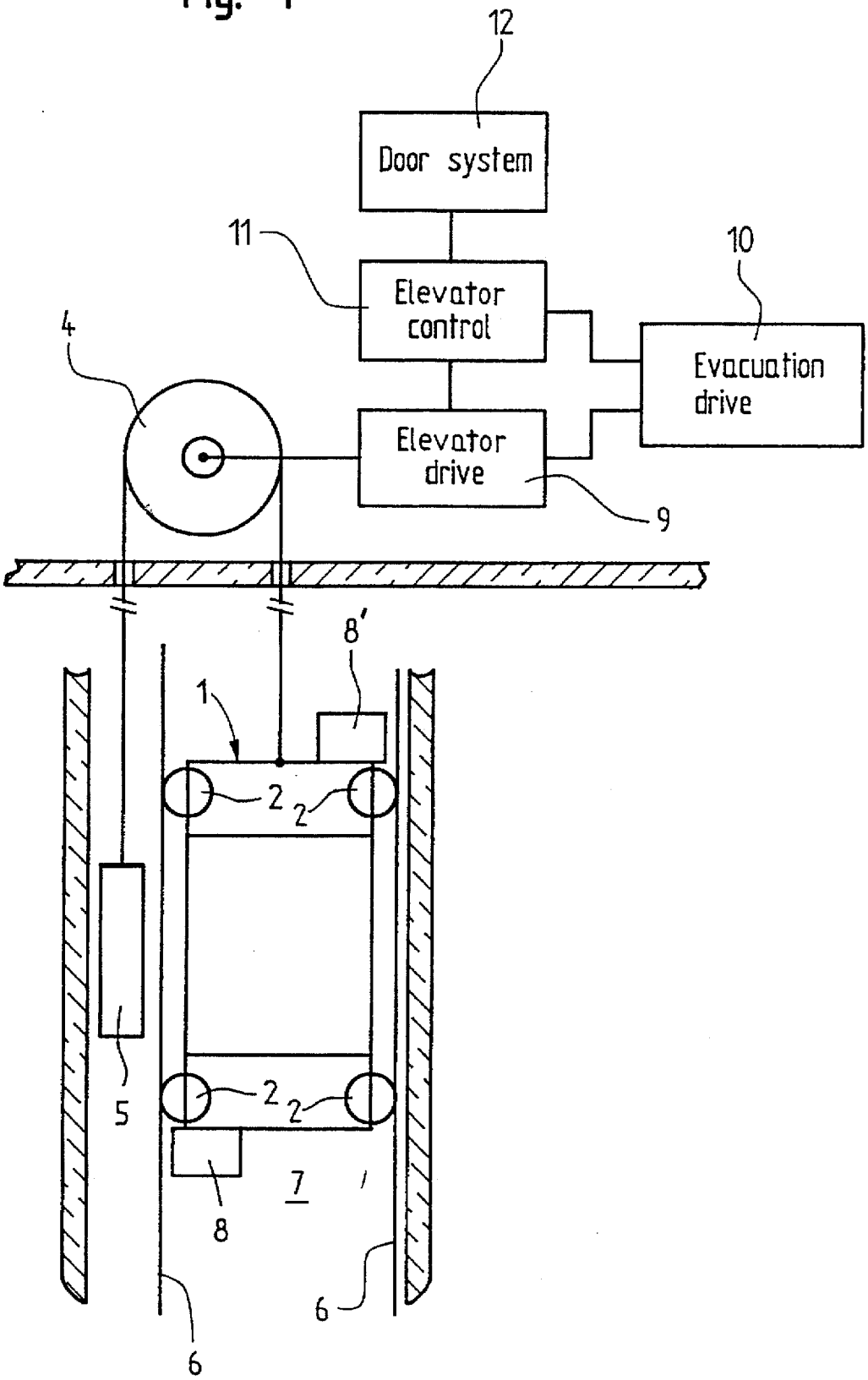
FIG. 1 is a schematic view of an elevator system having an evacuation system in accordance with the present invention.

There is shown in the FIG. 1 an elevator car 1, which is movable in upward and downward directions within a shaft 7 and having a plurality of guide rollers 2 attached to the car for engaging vertically extending guides 6 mounted in the shaft. The elevator car 1 is connected with a counterweight 5 by a cable 3 extending over a drive pulley 4 mounted at the top of the shaft 7. A first brake control apparatus 8 is attached beneath the elevator car 1 at one side adjacent one of the guides 6, i.e. at the bottom left, and another or second brake control apparatus 8' is attached on top of the car at an opposite side, i.e. at the top right. The drive pulley 4 is mechanically coupled for rotation by an elevator drive 9 which is electrically connected to an elevator control 11. A door system 12 is electrically connected with and controlled by the elevator control 11 and an evacuation drive 10 is connected electrically with the elevator control and mechanically coupled to the elevator drive 9.

Figure 2:
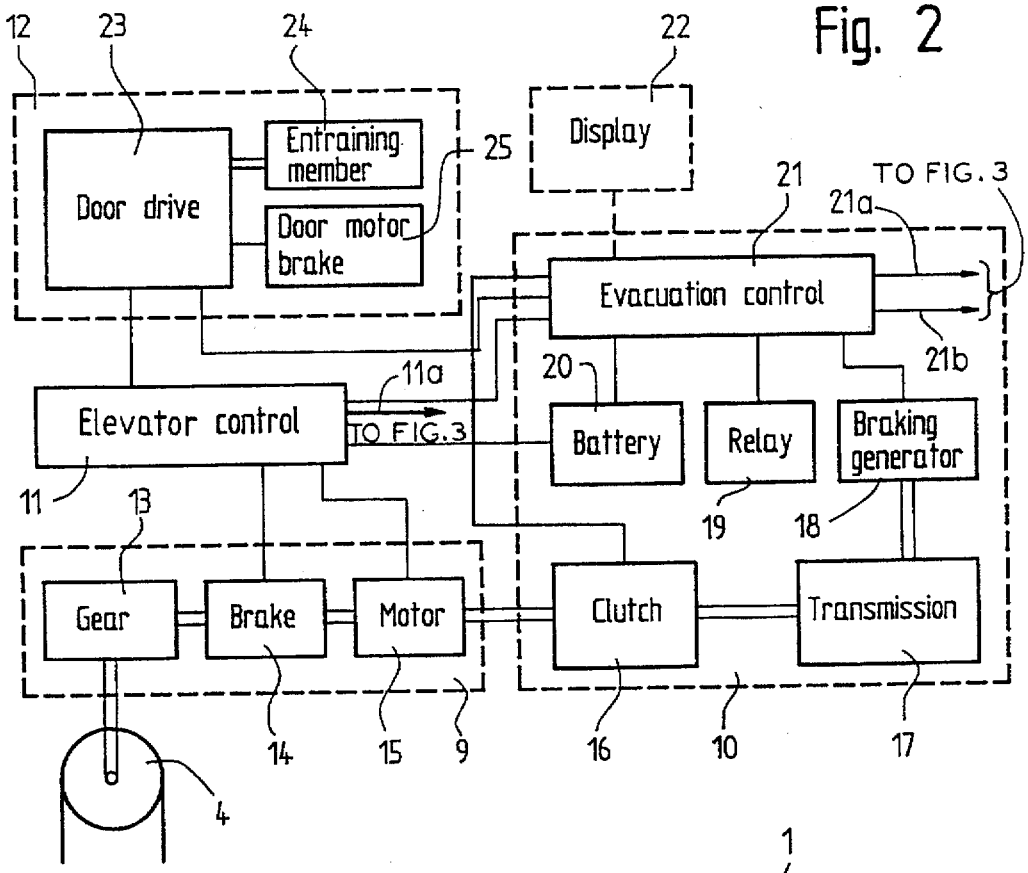
FIG. 2 is block diagram of the elevator control and the evacuation system shown in the FIG. 1.

The elevator drive 9, the evacuation drive 10, the elevator control 11 and the door system 12 are shown in more detail in the FIG. 2 with electrical connections illustrated as double connecting lines and electrical connections illustrated as single connecting lines. The elevator drive 9 includes a gear 13 mechanically coupled to the drive pulley 4, a brake 14 mechanically coupled to the gear and a motor 15 mechanically coupled to the brake. The motor 15 rotates the drive pulley 4 through the gear 13 and any rotation of the drive pulley can be stopped by the actuation of the brake 14. The brake 14 and the motor 15 are electrically connected to the elevator control 11 for actuation thereby.

The door system 12 includes a door drive 23 which, apart from door panels (see the FIG. 10), controls an entraining and latching system 24 and a door motor brake 25. The door drive 23 is mechanically coupled to the entraining and latching system 24 and is electrically connected to the door motor brake 25 whereby the elevator door is kept closed and latched during the travel of the elevator car 1 with the door motor switched off and the door motor brake applied. The entraining and latching system 25 serves to mechanically couple the car 1 with the shaft door at the stopping floors and to mechanically separate and latch in the closed state during the travel between floors. The door drive 23 is electrically connected to the elevator control 11 for actuation thereby.

The evacuation drive 10 includes a clutch 16 mechanically coupled between the motor 15 and a transmission 17. The clutch 16 is preferably actuated electromagnetically and is electrically connected to an evacuation journey control 21 which generates the corresponding commands. In the current-free state, the mechanical connection between the motor 15 and the transmission 17 is interrupted by disengagement of the clutch 16. The transmission 17, in the case of the clutch 16 being activated, transmits the rotational movement of the motor 15 to a braking generator 18 through a mechanical coupling. The transmission 17 has a transmission ratio which is preferably greater than 1:1 and can be executed as flat belt, toothed belt, band or spur wheel gear in one or more stages. The braking generator 18 can be executed as simple permanent magnet direct current machine. The braking generator 18 is selectively electrically connected with a battery 20 through the evacuation control 21 by switching relays 19 electrically connected to the evacuation control. The electrical connection between the braking generator 18 and the evacuation control 21 permits the detection of movement and rotational direction of the braking generator and, by way of an electrical connection between the battery 20 and the elevator control 11, the battery is constantly kept at a full state of charge. The evacuation control 21 also is electrically connected to the door drive 23 and to the elevator control 11 for the exchange of command and information signals. A pair of lines **21*a*** and 21*b* extend from the evacuation control 21 and are electrically connected to elements in the brake control apparatus 8 shown in the FIG. 3. An optional display 22, such as a video monitor or an active matrix screen, is shown in dashed line with an electrical connection to the evacuation control 21 and can be mounted in the elevator car 1 for displaying information to the passengers.

Figure 3:
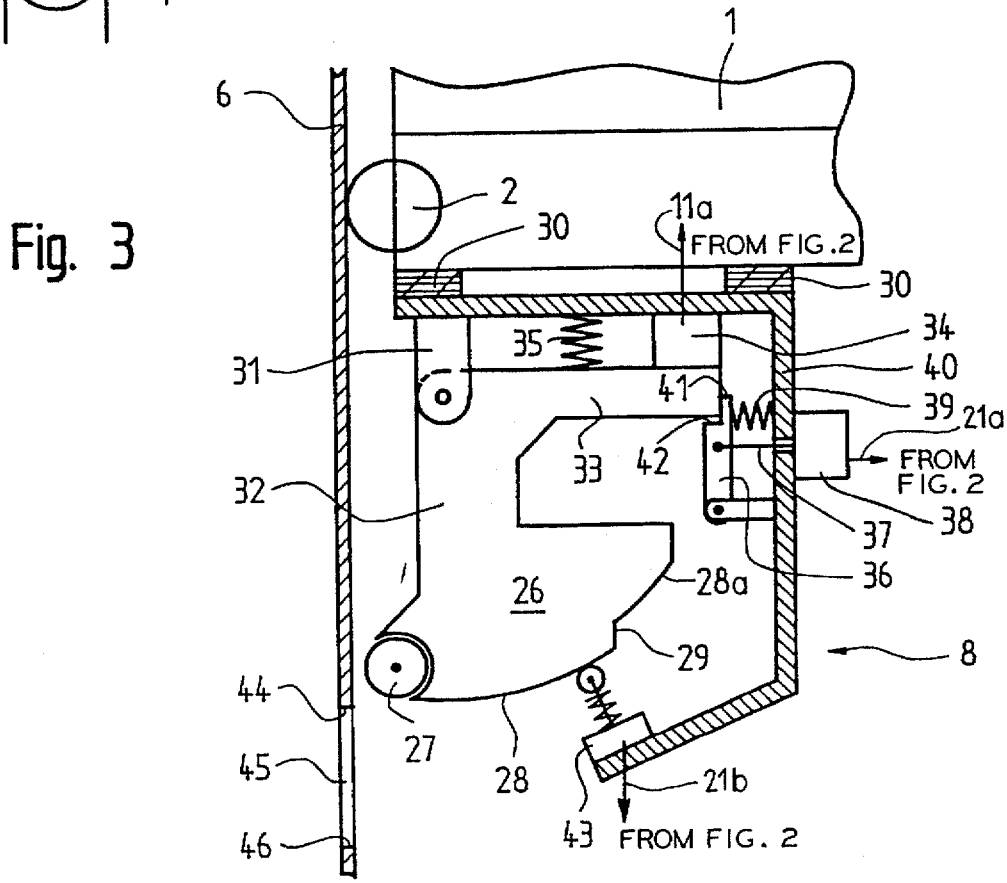
FIG. 3 is a schematic view of the brake control apparatus shown in the FIG. 1.

As shown in the FIG. 3, the brake control apparatus 8 mounted below the elevator car 1 is attached by damping elements 30. The brake control apparatus 8 includes a carrier bracket 40 having a generally horizontally extending leg with an upper surface attached to the damping elements 30 and a lower surface on which a brake pawl 26 is pivotally mounted in a downwardly directed bearing support 31. The brake pawl 26 is constructed with a generally L-shaped body having a generally horizontally extending arm 33 attached to a generally vertically extending arm 32 at the bearing support 31. The horizontal arm 33 extends to the right and is retained at an upper edge of an outer free end by a resetting element 34 which is attached to the lower surface of the horizontal leg of the carrier bracket 40. The resetting element 34 can be, for example, an electromagnet which is electrically connected by the line 11*a* to the elevator control 11 shown in the FIG. 2 for activation. A spring 35 is mounted on the lower surface of the horizontal leg of the carrier bracket and applies a downwardly directed force on the horizontal arm 33 against the holding force of the activated resetting element 34.

A triggering element 38 is mounted on a right surface of a generally vertically extending leg of the carrier bracket 40 and is mechanically coupled by a tension bolt 37 extending through the vertical leg to a middle portion of a generally vertically extending pawl lever 36. The pawl lever 36 has a lower end pivotally attached to a right surface of the vertical leg of the carrier bracket 40. The pawl lever 36 also has an upper end free end attached to one end of a pawl spring 39 having an opposite end attached to the right surface of the carrier bracket 40. The triggering element 38 can be, for example, an electromagnet connected by the line 21*a* to the evacuation control 21 shown in the FIG. 2. The upper free end of the pawl lever 36 has a vertically extending upper abutment lug 41 formed thereon which is forced into abutment with the facing free end of the horizontal arm 33 by the force of the pawl spring 39. A generally horizontally extending abutment surface 42 is formed on the upper end of the pawl lever 36 at the base of the lug 41 and is spaced below the free end of the arm 33.

A roller 27 is pivotally mounted on a leftward extension of a lower free end of the vertical arm 32 which extension projects downwardly to the left toward the guide 6. The lower free end of the vertical arm 32 extends to the right from the roller 27 rising to form a first arcuate switching gate 28 which ends at a generally vertically extending switching flank 29. The lower end of the arm 32 extends to the right from the flank 29 rising to form a second arcuate switching gate 28*a* of smaller radius than the gate 28. The switching gate 28 is abutted by a spring extended roller of a brake control contact 43 mounted on the left surface of a lower free end of the vertical leg of the carrier bracket 40 which free end is bent to the left. The brake control contact 43 is connected by the line 21*b* to the evacuation control 21 shown in the FIG. 2. As described below, pivotal movement of the brake pawl 26 in a clockwise direction about the pivotal attachment to the bearing support 31 results in actuation of the brake control contact 43. Such actuation is accomplished by a mechanical switching element such as a switching opening 45, which is formed in the guide 6, with an upper entry edge 44 and a lower, force-receiving stopping edge 46.

Figure 4:
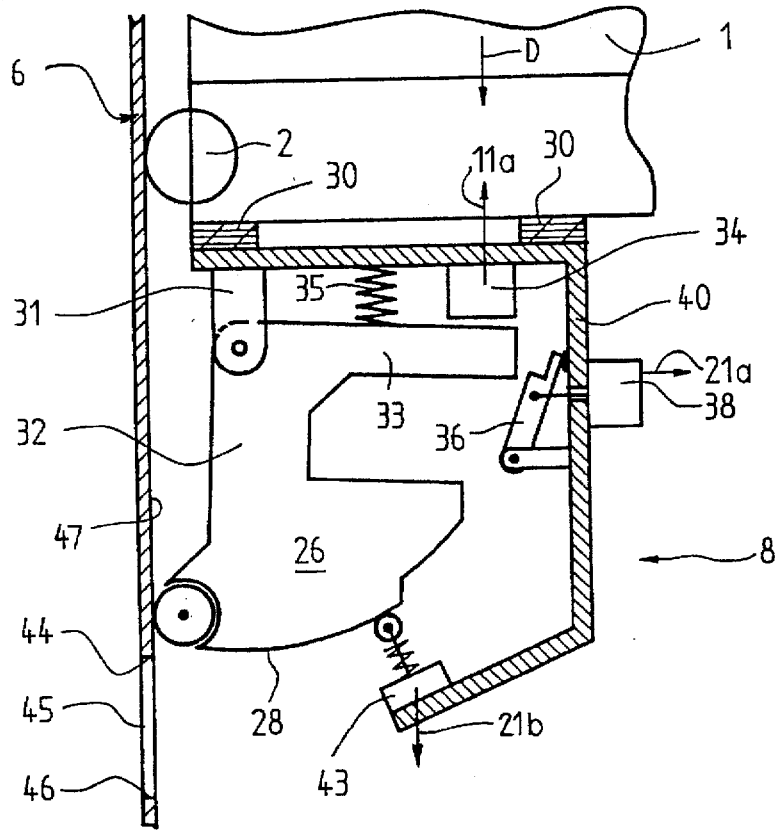
FIG. 4 is a view similar to the FIG. 3 showing the brake control apparatus during evacuation travel.
Figure 5:
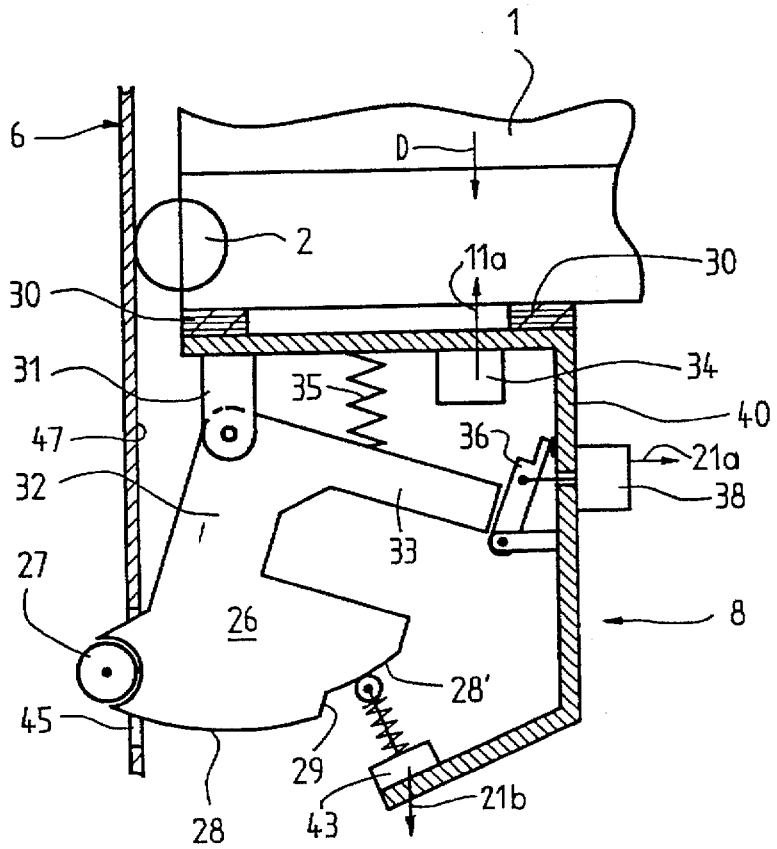
FIG. 5 is a view similar to the FIG. 3 showing the brake control apparatus during a final phase of the evacuation travel.
Figure 6:
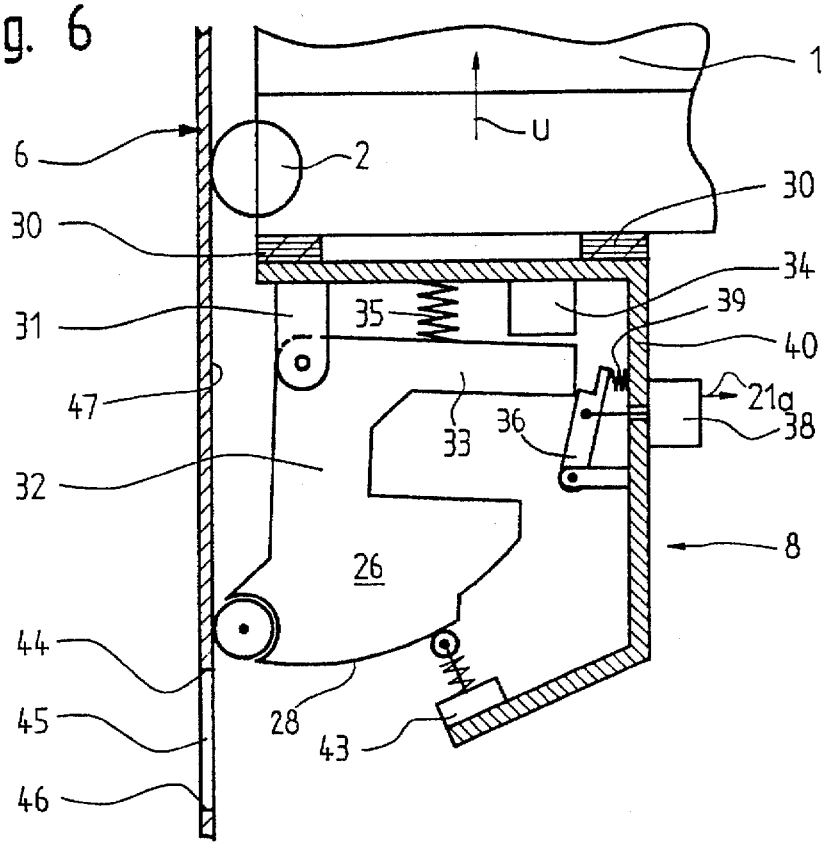
FIG. 6 is a view similar to the FIG. 3 showing the brake control apparatus during resetting travel.

In the FIGS. 4, 5 and 6, the brake control apparatus 8 is shown in different functional states which are during evacuation travel, during the final phase of the evacuation travel and during resetting travel. These functional states are explained in more detail below.

Figure 7:
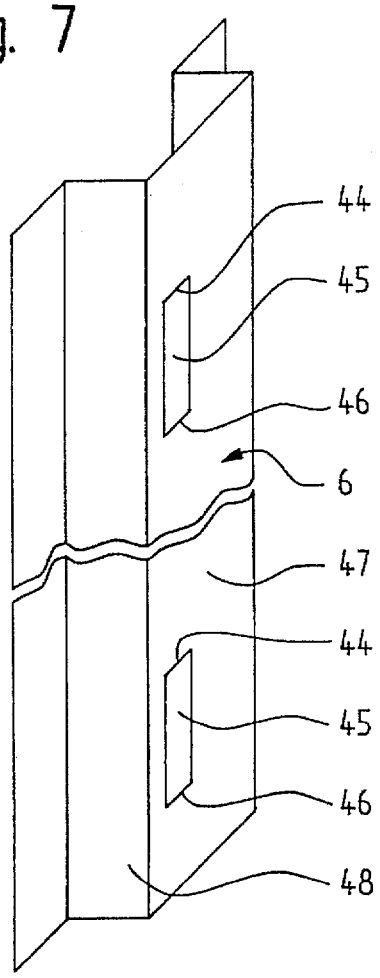
FIG. 7 is a fragmentary perspective view of the guide member shown in the FIG. 1 with a switching opening and a travel track.

In the FIG. 7 there is shown the guide 6 with a pair of the switching openings 45 formed therein. The guide 6 is preferably constructed from metal sheets in sections, preferably by a bending technique. The guide 6 has a generally U-shaped cross section with outwardly extending flanges that serve for fastening the guide on the wall of the shaft 7 or on a carrier mounted in the shaft. The surfaces extending at right angles to the flanges and to a center section in which the switching openings 45 are formed each provide a travel track 48 for the guide rollers 2. A third travel track 47 for the guide rollers 2 is provided by the surface of the center section of the guide 6 which faces the elevator car 1. The switching openings 45 are positioned at floors and are so dimensioned that the released brake pawl 26 can pivot partially into them. The width of each opening 45 is about twice the thickness of the brake pawl 26 and the height is so dimensioned that a few centimeters of the opening, the vertical length of which is greater than the brake travel of the car 1 in the case of a mechanical final braking after an evacuation journey, remain free underneath a brake pawl pivoted out into the switching opening. The stop edge 46 serves as a safety abutment and can, in the case of a too weak mechanical final braking stop of the car 1, take up the load of the impinging car mass.

Figure 8:
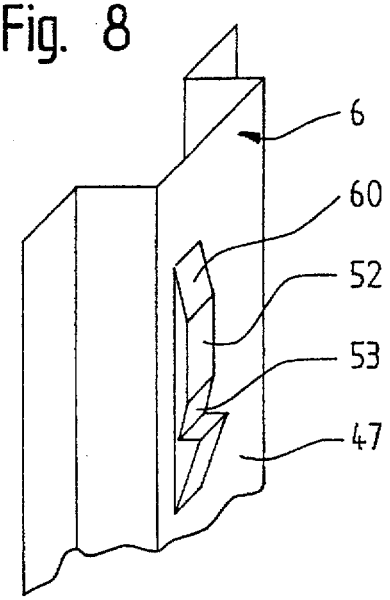
FIG. 8 is a fragmentary perspective view of the guide member similar to the FIG. 7 with an alternate embodiment of the switching element.

There is shown in the FIG. 8 an alternate embodiment of a mechanical switching element to be contacted by the brake pawl 26. In place of the opening 45, a raised switching gate or cam 52 is provided with a run-up ramp 60 formed at an upper end and a notched-in stop abutment 53 formed at a lower end. The flat portion of the cam 52, which extends parallel to the third travel track 47 of the guide 6, has a vertical length which is greater than the braking travel of the car 1 in the case of a mechanical final braking stop after an evacuation journey. The switching gate 52 is active for brake control during downward travel. The stop abutment 53 serves as a safety abutment and can, in the case of a too weak mechanical braking stop the car 1, take up the load of the impinging car mass.

Figure 9:
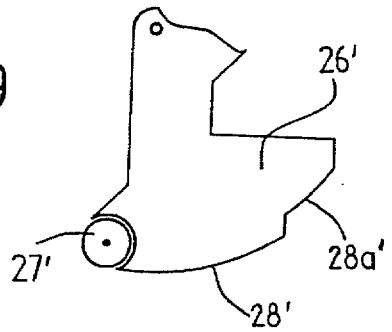
FIG. 9 is a fragmentary view of a portion of the brake pawl shown in the FIG. 3.

In the FIG. 9 there is shown a brake pawl 26' for use with the switching cam 52. The difference from the shape of the brake pawl 26 shown in the FIG. 3 is that a roller 27' is much smaller in diameter than the roller 27 in order that it does not run across the stop notch 53 in an emergency.

Figure 10:
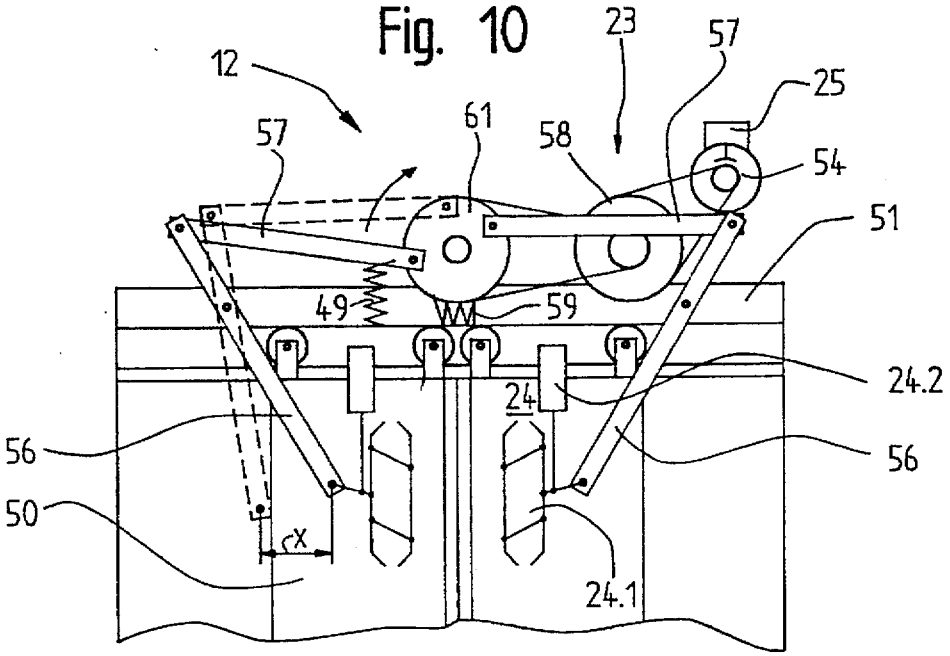
FIG. 10 is a schematic view of the door system shown in the FIG. 1.

In the FIG. 10 there is shown the door system 12 as a typical center opening door system having the door drive 23 which includes a door motor 54 with the door motor brake 25. The motor 54 drives a belt gear 58 which drives a crank pulley 61. The crank pulley 61 is attached to horizontal levers 57 which are attached to pivot levers 56. The pivot levers 56 are coupled by small intermediate levers to door panels 50. At the beginning of a door opening process, the pivot levers 56 actuate an entraining and latching system 24 which consists of an entraining parallelogram 24.1 and a door latch 24.2. Door drives of this kind include, mostly between the crank pulley 61 and a door drive carrier 51, a small first compression spring 59 which is utilized to push the horizontal levers 57 back over the dead center of the crank pulley 61 when the door drive 23 is switched off. According to experience, the force exerted by the compression spring 59 is not sufficient to open a sliding door of this kind, for example, by ten to fifteen centimeters upon arrival of the car 1 at a floor after an evacuation journey. For that reason, an additional or second compression spring 49 is provided, which is arranged between the door drive carrier 51 and the left-hand horizontal lever 57. The force and travel of the spring 49 are so dimensioned that both of the horizontal levers 57 are pushed at least into the position indicated in dashed lines when the door drive 23 is switched off at a floor. This force results in a door opening which corresponds to twice a distance "X" and can be enough that a person can slip through or at least open the door further with very little effort. Subject to consideration of the crank kinematics, it is important that the crank pins of the crank pulley 61 are positioned at least 45° beyond the dead center position for a manual opening, because the force effort needed could otherwise be too great, in particular for older passengers, for a manual opening.

The operation of the present invention is initiated to perform an evacuation journey when, for example, a defect in the elevator drive 9 or the elevator control 11, or a power failure during a normal journey with passengers. If a power failure occurs, the elevator car 1 is stopped by the switched-off motor 15 and the automatically actuated brake 14. If it is assumed that the elevator car 1 is almost fully loaded with passengers, a driving load results in a downward direction. If the elevator car 1 by chance stops at a floor, the passengers can readily step out and are released. However, there is a substantially greater probability that the elevator car 1 will stop between two floors and the passengers are confined. The evacuation control 21 initiates an evacuation journey when there is an emergency stop outside a door zone, the elevator car 1 is loaded, and the elevator does not resume the normal operation before the elapse of a short waiting time.

Initially, a not illustrated emergency light is switched on and a text display, which is programmed in the evacuation control, can appear on the display 22 (shown in the FIG. 2) for the information of the confined passengers. The evacuation control 21 now starts an evacuation journey sequence which causes a retraction of the pawl lever 36 by activation of the triggering element 38, whereby the brake pawl 26 pivots clockwise until the roller 27 contacts the guide 6 as shown in the FIG. 4. The pivoting of the brake pawl 26 became possible because, after the power failure, the resetting element 34 is de-activated and the spring 35 urges the brake pawl into the position shown in the FIG. 4.

At the same time, the clutch 16 is switched in and the brake 14 is lifted. Due to the driving load in a downward direction illustrated by an arrow D, the car 1 begins to move in the downward direction and drives the brake generator 18 through the clutch 16 and the transmission 17. The entraining parallelogram 24.1 is forced into an open position which is wider than that required to couple with the shaft door so that the elevator car door can not be opened. The brake generator 18, which initially is not connected to the battery 20, acts as a tachodynamo and supplies a voltage, which is of a polarity dependent on the direction of rotation, to the evacuation control 21. The evacuation control 21 then connects the brake generator 18 with the correct polarity to the battery 20 utilizing the switching relays 19. The rotational speed of the preferably permanently excited brake generator 18 is now accelerated by the driving load until its output voltage reaches that of the battery 20 and maximally exceeds it by about 10%. The battery 20, with its known small internal resistance, now acts as a rotational speed stabilizing load for the brake generator 18 and the elevator car 1 descends at a low constant speed. Preferably, a very low speed is provided for the evacuation journey by the appropriate choice of the transmission ratio in the transmission 17, because the rated output of the brake generator 18 can thereby be kept correspondingly small and safety is improved.

During the evacuation journey in the downward direction, the roller 27 of the brake pawl 26 rolls on the third travel track surface 47 of the guide 6 to the location of the next lower switch opening 45. Shortly before reaching the switch opening 45, the door zone is reached whereupon the entraining and latching system 24 moves between the entraining rollers of a shaft door and causes an unlatching of the car doors and the shaft doors. Upon the mechanical unlatching of the doors, the springs 49 and 59 (shown in the FIG. 10) push the car and shaft doors open so far that the floor becomes visible through the large door gap and the final phase of the evacuation journey can be perceived. As mentioned above, it is possible with the additional opening spring 49 to open the doors so far that the doors are afterwards very easily opened by hand. The spring 49 is dimensioned only to be strong enough that the crank drive is pushed back just beyond the dead center position in order to meet the corresponding elevator regulation. The opening spring 49 eliminates any requirement of providing power and control to the door motor by the evacuation control 21. The opening spring 49 also can be located in any other place within the mechanical force transmission elements of a door drive. The movement of the roller 27 to the switch opening 45 causes a further clockwise pivot of the brake pawl 26 to the position illustrated in the FIG. 5. Hereby, the first switching gate 28 also is moved clockwise and the brake control contact 43 is actuated when the associated actuating roller moves along the switching flank 29 to abut the second switching gate 28*a*. Actuation of the brake control contact 43 causes the immediate dropping-in of the brake 14, the switching-off of the clutch 16 and the interruption of the electrical connection between the brake generator 18 and the battery 20. The elevator car 1 is now stopped by the dropped-in brake 14. The stopping of the car 1 takes place within a very short brake travel due to the low speed during the evacuation journey. The speed for the evacuation journey and the vertical length of the switch openings 45 are so designed that the brake pawl 26 just does not touch the stopping edge 46 after the car 1 stops. If the brake 14 were set too weak, the brake pawl 26 would contact the stopping edge 46 and stop the elevator car 1 securely within the door zone. A slight shock, mitigated by the damping elements 30, would then be perceivable by the passengers. The unlatched car and shaft doors, due to the already large width opening, can be pushed open entirely with a minimum effort in case the opening width is not already sufficient for the slipping-through of a person to exit the car 1.

Figure 12:
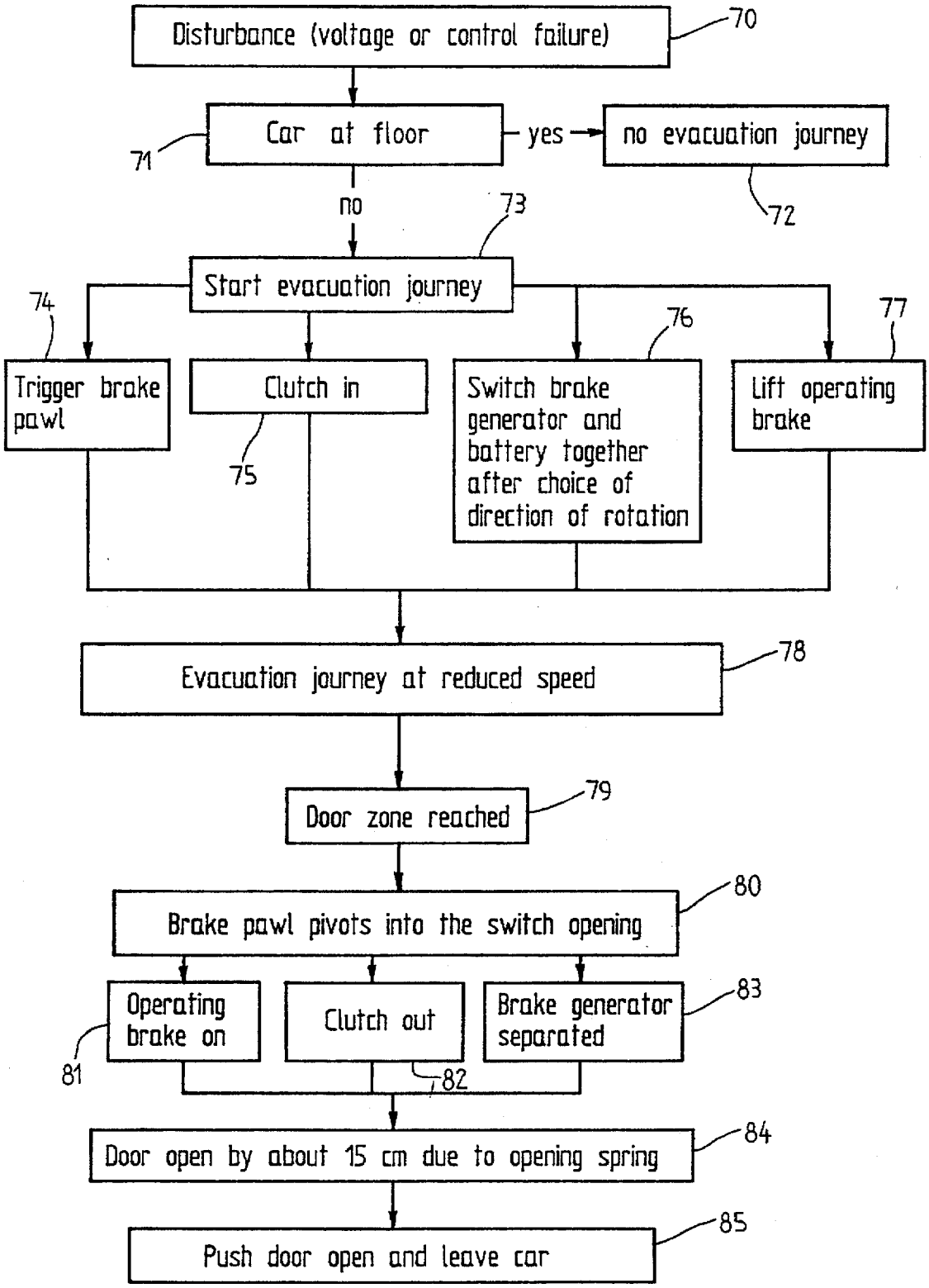
FIG. 12 is a flow diagram of an evacuation journey.

In order that the doors can be pushed to and fro by hand with a tolerable force effort, as described above, the entire door drive mechanism must be free-running in this car position. This requires that the door motor brake 25 is or must be lifted. It is furthermore assumed that, as is usual for present day technique, the entire drive mechanism is constructed to be not self-locking. The sequence of the evacuation journey is illustrated in the flow diagram shown in the FIG. 12. A disturbance, such as a power or control failure, is detected in a step 70. In a step 71 a check is made to determine if the car is at a floor. If the car is at a floor, the sequence branches at "yes" to a step 72 in which a decision is made that no evacuation journey is required. If the car is not at a floor, the sequence branches at "no" to a step 73 in which the evacuation journey is started with several steps.

The evacuation journey first executes a step 74 in which the brake pawl 26 is triggered to rotate by activation of the triggering element 38. Next, a step 75 is executed in which the clutch 14 is switched in. Then, a step 76 is executed in which the brake generator 18 and the battery 20 are connected after the direction of rotation of the generator has been determined. Finally, a step 77 is executed in which the brake 14 is lifted. After the steps 74 through 77 have been executed, the journey enters a step 78 in which the car 1 is moved downwardly at a low speed. In a step 79, the next door zone is detected when the car reaches it. A step 80 is then executed in which the brake pawl 26 pivots into the switch opening 45 causing actuation of the brake control contact 43. Now movement of the car 1 is stopped with several steps. A first step 81 is executed in which the car brake 14 is actuated. Next, in a step 82, the clutch 16 is dropped out. Finally, in a step 83, the brake generator 18 is disconnected from the battery 20. In a step 84, the spring 59 causes the car and floor doors to open approximately fifteen centimeters. Then, in a step 85, the passengers can push the doors open and leave the car.

Figure 13:
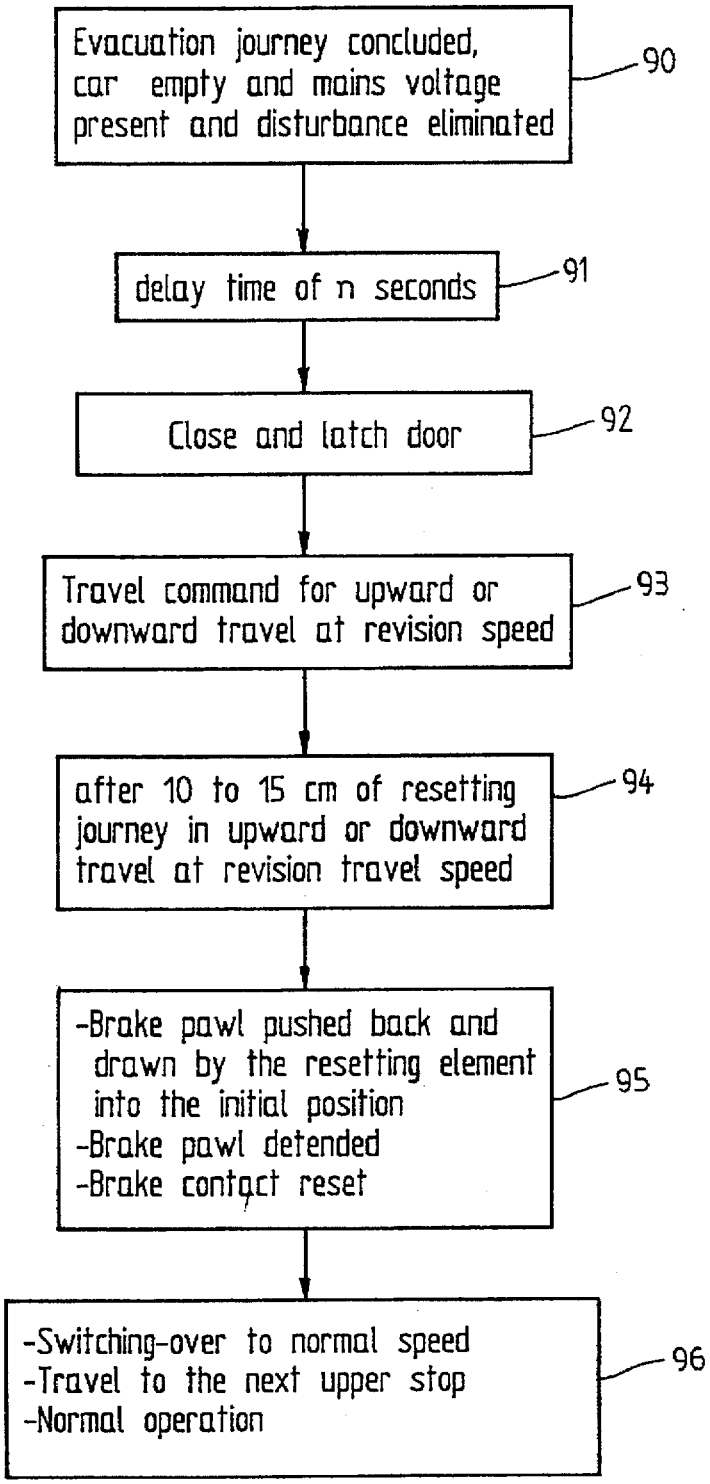
FIG. 13 is a flow diagram of a resetting journey.

It is important that the elevator system be reset automatically to the normal operating state after an evacuation journey. However, this is possible only when the causes of the evacuation journey are eliminated. In case the cause, as assumed above, was a short-term power failure, a so-called resetting journey, as illustrated in a flow diagram shown in the FIG. 13, takes place after a predetermined time delay after restoration of the supply voltage.

In a step 90, a check is made to determine whether the evacuation journey has concluded, the car is empty, the main power has been restored and the cause of the disturbance has been eliminated. When these conditions for a resetting journey are fulfilled, a step 91 is executed causing a preset delay of "n" seconds. Then, the car and shaft doors are closed and latched in a step 92. The evacuation control 21 generates a travel command to the elevator control 11 in a step 93, whereupon a resetting journey of upward or downward travel is started at a preprogrammed revision speed. The revision speed is a low speed and should, for example, not exceed 0.2 meters per second. During this resetting journey, after approximately ten to fifteen centimeters of travel in a step 94, the brake pawl 26 is pushed out of the switch opening 45 and rotated counterclockwise to move the brake control contact 43 back into its original position on the first switching gate 28. Such movement, in an upward direction as illustrated by an arrow U, is shown in the FIG. 6. In a step 95, due to the triggering element 38 being de-activated after the end of the evacuation journey, the triggering pawl lever 36 is forced against the free end face of the horizontal arm 33. Because power also is applied to the resetting element 34 by the safety circuit in the elevator control 11 and the air gap between the upper side of the horizontal arm 33 and the excited resetting element 34 has become smaller due to the rotation of the brake pawl 26, the brake pawl can be drawn into the original position shown in the FIG. 3 by the electromagnetic force of the resetting element and the pawl lever secured mechanically in its original position. Also, the brake control contact 43 is reset to signal the elevator control 11 to switch the motor 15 over to the nominal speed causing the elevator car 1 to travel further upwardly normally to the next higher floor and stop regularly there in a step 96. Upon the arrival of the elevator car 1 at this floor, the car is ready for normal operation.

If the cause of the evacuation journey was an irreversible disturbance in the form of a control or regulation defect, no resetting journey will take place and a corresponding display inside the car and/or at the floor signals "out of use" to potential passengers. A report, which is usual according to present day technique, is sent to a monitoring center.

In the case of cable elevators, the lead conditions can be such that no driving lead is present to drive the brake generator 18. Then, an electrical connection with the battery 20 is made in both polarities twice at short time intervals by way of the switching relays 19 and the necessary current for a driving of the brake generator and thus of the elevator car is measured both times. The polarity of connection or direction of rotation, which is more favorable for the energy expenditure, is thus chosen. Thereby, an evacuation journey in an upward direction will take place in the case of a lightly loaded car.

Figure 11:
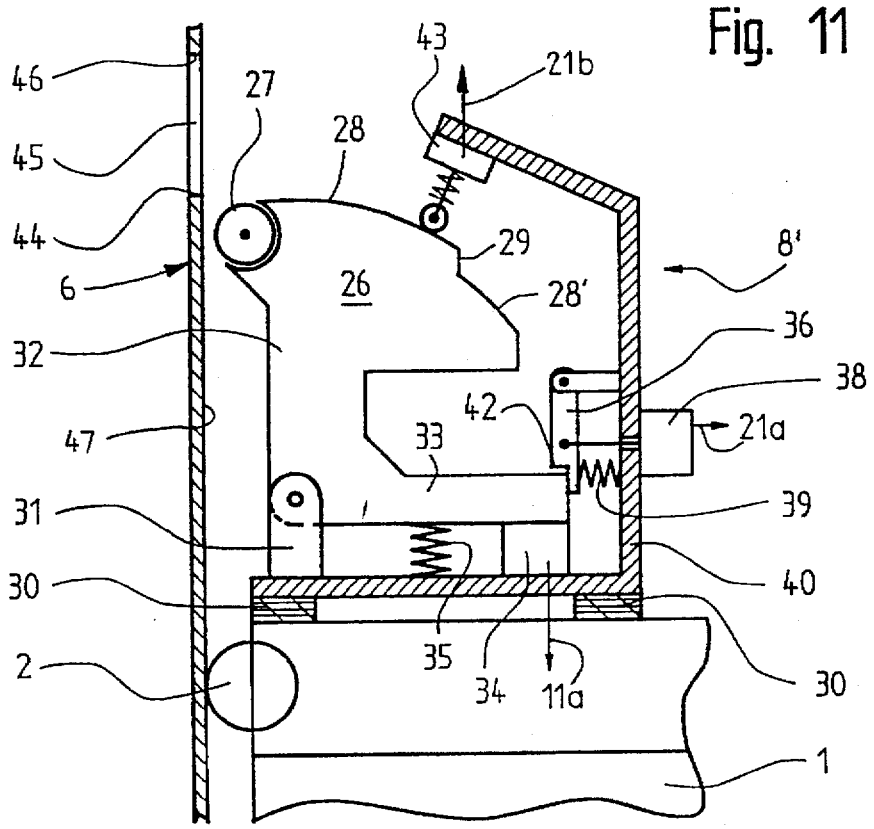
FIG. 11 is a schematic view of a brake control apparatus on an upper side of the elevator car.

For an evacuation journey in upward direction, the second brake control apparatus 8' is activated. The second brake control apparatus 8' is arranged on the upper side of the car 1 and on the oppositely disposed side preferably turned through 180° about the horizontal axis, as illustrated in the FIG. 11. The switch openings 45 are formed in the oppositely disposed guide 6 in the same manner as described above, with the difference that they are displaced upwardly by the vertical distance between both the brake control apparatuses 8 and 8' and that the upper edge of the switch opening is the stopping edge 46. The brake pawl 26 then functions in exactly the same manner as described below except that the directions of rotation are reversed. The evacuation journey and the following resetting journey likewise take place in the same manner as already described, however in the reverse direction of travel.

In the case of cable elevators, the capacity of the battery 20 is selected according to the energy requirement for the movement of the elevator car 1 with a load balanced-out by the associated counterweight. For this case, however, no load is to be lifted by the evacuation drive 10, but only the friction of the elevator drive 9 need be overcome.

In place of the roller 27 on the brake pawl 26, the corresponding outline can be formed integrally with the brake pawl as one piece. Due to the relatively light contact pressure on the guide 6 after the triggering, no lubrication is necessary and at most a slight wiping noise will be audible. The function of the brake control apparatus 8 is not impaired.

In place of the switching openings 45, the switching cams 52, shown in the FIG. 8, can be used for the actuation of the brake pawl 26. In order that the switching cam 52, in the case of weak mechanical braking, assures a secure stopping of the car 1 at the floor, the stopping notch 53 is provided. For secure engagement of the roller 27' (shown in the FIG. 9) in the notch 53, the roller preferably is of a smaller diameter than the roller 27 used with the switching openings 45. The brake pawl 26' or a first switching gate 28' furthermore has an outfine adapted to this mode of operation in order to actuate the brake contact 43 in the correct manner and the evacuation control 21 includes a corresponding logic system in order that the operation thereof upon the running onto the switching cam 52 are the same as for the pivoting into the switch opening 45. The advantage of the switching cams 52 in place of the switching openings 45 is that these cams can be placed other than on the third travel track 47, for example, on a shaft wall for use with conventional guides in a T-shape profile. It is also possible with appropriate effort to locate the switching openings 45 other than in the guides 6 as shown in the FIG. 7. Separate elements with a switching opening 45 formed therein can be mounted at almost any desired location in the shaft independently of the guide rail type.

The described evacuation system is also usable for elevators without cables. Elevators of this kind can be constructed without a counterweight and include an individual drive. The car masses are then relatively great, which masses must be taken into consideration in the selection of the capacity of the brake generator 18 or for one of the alternative brake devices mentioned below. On the other hand, the course of an evacuation journey will always take place in the same direction of travel, thus downwards, which makes the direction of travel decision logic in the evacuation control 21 superfluous as well as also simplifies the entire evacuation equipment, since only one brake apparatus 8 underneath the car 1 is required. If necessary, another one of the brake apparatuses 8 can be mounted underneath the car 1 for operation in parallel and, in case of emergency with poor braking, catch the car mass on opposite sides.

If the brake 14 is a regulatable brake, the brake generator 18, the transmission 17 and the clutch 16 are not required and a regulation of the speed for the evacuation journey can take place by way of brake force regulation under the control of the evacuation control 21.

In a further simplified variant of the evacuation journey braking, a fluid brake can be provided, which is driven by the transmission 17 and is of the kind which has a torque converter in an automatic car gear. Due to the typical steep torque characteristic of such a fluid brake, a great stability for the evacuation journey speed is likewise assured. With correspondingly stronger capacity of the fluid brake, it is possible to connect the brake mechanically with the motor 15 directly without the transmission 17 by way of the clutch 16.

The transmission 17 can be constructed in different ways. Possibilities are belt gears (flat belts, V-belts, toothed belts), friction wheel gears or spur wheel gears. The translation factor is dependent on the characteristics of installed braking or driving power, evacuation journey speed, functional reliability and permissible evacuation time.

The same braking effect provided by a fluid brake also can be achieved by an electrical eddy current brake. An eddy current brake can be constructed as a separate machine in place of the brake generator 18 and be attached directly to the motor 15.

As further possibility, for example, two phases of the motor 15 can be excited by direct current from the battery 20 during the evacuation journey, which has the consequence of the same effect, thus causes a reliable braking. With a direct current braking of the motor 15, the clutch 16, the transmission 17 and the braking generator 18 are not required. The switching relays 19 are then used for this current circuit.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An evacuation drive system for an elevator car which travels along guides in an elevator shaft, the car having doors operated by an automatic door system, being moved in upward and downward directions by a motor and being stopped by a brake, and an elevator control connected to the door system for opening and closing the car doors at floors, to the motor for moving the car between floors and to the brake for stopping the car at floors, the evacuation drive system comprising:

an evacuation control adapted to be connected to an elevator control and to an automatic door system of an elevator car, said evacuation control being responsive to a disturbance in a normal operation of the car for automatically moving the car along guides in an associated elevator shaft on an evacuation journey to a nearby floor for release of passengers confined in the car;

a means for regulating a speed of the car during the evacuation journey connected to said evacuation control and adapted to be mechanically coupled to the car;

at least one brake control apparatus adapted to be mounted on the elevator car and connected to the evacuation control for initiating a final stop of the evacuation journey at the nearby floor;

a shaft position information means adapted to be mounted in the elevator shaft adjacent the floors for actuating said brake control apparatus to initiate said final stop; and a spring means adapted to be attached to the door system for pushing door panels of the door system partially open at said final stop.

2. The evacuation system according to claim 1 wherein said means for regulating a speed includes a clutch adapted to be mechanically coupled to a motor driving the car and connected to said evacuation control, a brake generator connected to said evacuation control, a transmission mechanically coupled between said clutch and said brake generator, a battery connected to said evacuation control and adapted to be connected to the elevator control and a switching relay connected to said evacuation control whereby when a disturbance in the normal operation of the car occurs, said evacuation controls actuates said clutch to drive said brake generator and actuates said switching relay to connect said braking generator to said battery.

3. The evacuation system according to claim 1 wherein said means for regulating a speed is regulatable brake coupled to a motor driving the car and connected to said elevator control whereby when a disturbance in the normal operation of the car occurs, said evacuation controls regulates said brake through the elevator control.

4. The evacuation system according to claim 1 wherein said means for regulating a speed includes a clutch adapted to be mechanically coupled to a motor driving the car and connected to said evacuation control, a fluid brake mechanically coupled to the motor and connected to the evacuation control and a transmission mechanically coupled between said clutch and said fluid brake whereby when a disturbance in the normal operation of the car occurs, said evacuation control actuates said clutch to drive said fluid brake and regulates said fluid brake.

5. The evacuation system according to claim 1 wherein said means for regulating a speed includes a clutch adapted to be mechanically coupled to a motor driving the car and connected to said evacuation control and a fluid brake mechanically coupled to said clutch and connected to said evacuation control whereby when a disturbance in the normal operation of the car occurs, said evacuation control actuates said clutch to drive said fluid brake and regulates said fluid brake.

6. The evacuation system according to claim 1 wherein said means for regulating a speed is an electrical eddy current brake.

7. The evacuation system according to claim 1 wherein said means for regulating a speed is a battery connected to said evacuation control and a relay connected to said evacuation control for connecting said battery for direct current excitation of a motor driving the car.

8. The evacuation system according to claim 1 wherein said brake control apparatus includes damping means adapted to be attached to the car, a rotatable brake pawl releasably retained in a first predetermined position, trigger means connected to said evacuation control for selectively rotating said brake pawl from said first predetermined position to a second predetermined position, a resetting element connected to said evacuation control for rotating said brake pawl to and releasably retaining said brake pawl in said first predetermined position and means for detecting said second predetermined position of said brake pawl connected to said evacuation control.

9. The evacuation system according to claim 8 wherein said trigger means includes a triggering element connected to said evacuation control, a pawl lever engaging said brake pawl and being coupled to said triggering element by a tension bolt and a pawl spring for forcing said pawl lever into engagement with said brake pawl.

10. The evacuation system according to claim 8 wherein said means for detecting includes a pair of arcuate switching gates joined by a switching flank formed on said brake pawl and a brake control contact actuated by said switching gates.

11. The evacuation system according to claim 1 wherein said brake control apparatus includes a roller for engaging said shaft position information means and actuating said brake control apparatus.

12. The evacuation system according to claim 1 wherein said shaft position information means is a switching opening formed in a guide rail in the elevator shaft and having an entry edge and a stop edge at vertically spaced ends thereof, said switching opening receiving a portion of said brake control apparatus for actuating said brake control apparatus.

13. The evacuation system according to claim 1 wherein said shaft position information means is a switching cam mounted on a guide rail in the elevator shaft and having with a stop notch formed therein receiving said brake control apparatus for actuating said brake control apparatus.

14. An evacuation drive system for an elevator car which travels along guides in an elevator shaft, the car having doors operated by an automatic door system, being moved in upward and downward directions by a motor and being stopped by a brake, and an elevator control connected to the door system for opening and closing the car doors at floors, to the motor for moving the car between floors and to the brake for stopping the car at floors, the evacuation drive system comprising:

an evacuation control adapted to be connected to an elevator control and to an automatic door system of an elevator car, said evacuation control being responsive to a disturbance in a normal operation of the car for automatically moving the car along guides in an associated elevator shaft on an evacuation journey to a nearby floor for release of passengers confined in the car;

a means for regulating a speed of the car during the evacuation journey connected to said evacuation control and adapted to be mechanically coupled to the car;

at least one brake control apparatus adapted to be mounted on the elevator car and connected to the evacuation control for initiating a final stop of the evacuation journey at the nearby floor, said brake control apparatus including damping means adapted to be attached to the car, a rotatable brake pawl releasably retained in a first predetermined position, trigger means connected to said evacuation control for selectively rotating said brake pawl from said first predetermined position to a second predetermined position, a resetting element connected to said evacuation control for rotating said brake pawl to and releasably retaining said brake pawl in said first predetermined position and means for detecting said second predetermined position of said brake pawl connected to said evacuation control;

a shaft position information means adapted to be mounted in the elevator shaft adjacent the floors for actuating said brake control apparatus to initiate said final stop; and a means adapted to be attached to the door system for pushing door panels of the door system partially open at said final stop.

15. An elevator system comprising:

guides mounted in an elevator shaft;

an elevator car which travels along said guides, said car having an automatic door system with a door motor coupled through a drive pulley to car doors;

a drive motor coupled to said car for moving said car in upward and downward directions between floors along the guides;

a brake coupled to said car for stopping said car at the floors;

an elevator control connected to said door system for switching on said door motor for opening and closing said car doors at the floors, to said drive motor for moving said car between the floors and to the brake for stopping said car at the floors;

an evacuation control connected to said elevator control and to said automatic door system for sensing a disturbance in a normal operation of said car and automatically moving said car in the elevator shaft on an evacuation journey to a nearby floor for release of passengers confined in said car;

a means for regulating a speed of said car during said evacuation journey connected to said evacuation control and mechanically coupled to said motor and said brake;

at least one brake control apparatus mounted on said car and connected to the evacuation control for initiating a final stop at the nearby floor;

shaft position information means adapted to be mounted in the elevator shaft adjacent the floors and being responsive to said brake control apparatus for actuating said brake control apparatus; and a mechanical means attached to the door system for rotating said crank pulley away from a dead center position thereby pushing said car doors partially open at an end of said evacuation journey when said door motor is switched off. .

* * * * *